US009101895B2

(12) United States Patent
Lim et al.

(10) Patent No.: US 9,101,895 B2
(45) Date of Patent: Aug. 11, 2015

(54) SYSTEM FOR MIXING AND DISPERSING MICROBUBBLE PHARMACEUTICALS

(75) Inventors: Hae Won Lim, Niskayuna, NY (US); Cynthia Elizabeth Landberg Davis, Niskayuna, NY (US); James Edward Rothman, New York, NY (US)

(73) Assignee: General Electric Company, Niskayuna, NY (US)

( * ) Notice: Subject to any disclaimer, the term of this patent is extended or adjusted under 35 U.S.C. 154(b) by 1105 days.

(21) Appl. No.: 13/087,731

(22) Filed: Apr. 15, 2011

(65) Prior Publication Data

US 2012/0263009 A1 Oct. 18, 2012

(51) Int. Cl.

| | |
|---|---|
| ***B01F 15/06*** | (2006.01) |
| ***B01F 15/02*** | (2006.01) |
| ***B01F 11/00*** | (2006.01) |
| ***B01F 15/00*** | (2006.01) |

(52) U.S. Cl.

CPC ..... *B01F 11/0065* (2013.01); *B01F 15/00253* (2013.01); *B01F 15/00896* (2013.01); *B01F 15/065* (2013.01); *B01F 2215/0032* (2013.01)

(58) Field of Classification Search

CPC ..... B01F 11/0065; B01F 15/00253; B01F 15/065; B01F 15/00896; B01F 2215/0032

USPC ..... 366/144–146, 192, 275

See application file for complete search history.

(56) References Cited

U.S. PATENT DOCUMENTS

| | | | | |
|---|---|---|---|---|
| 5,312,592 | A | 5/1994 | Andersson | |
| 5,415,843 | A | 5/1995 | Andersson | |
| 5,542,935 | A | 8/1996 | Unger et al. | |
| 6,172,207 | B1 | 1/2001 | Damhaut et al. | |
| 6,392,246 | B1 | 5/2002 | Wiberg et al. | |
| 6,433,495 | B1 | 8/2002 | Wiberg | |
| 6,901,283 | B2 | 5/2005 | Evans, III et al. | |
| 6,981,794 | B2 | 1/2006 | Bibbo et al. | |
| 7,091,494 | B2 | 8/2006 | Weisner et al. | |
| 7,115,249 | B2 | 10/2006 | Luthra et al. | |
| 7,521,544 | B2 | 4/2009 | Kihlberg et al. | |
| 7,541,178 | B2 * | 6/2009 | Takagi et al. | 435/289.1 |
| 7,553,942 | B2 | 6/2009 | Itsenko et al. | |
| 7,577,228 | B2 | 8/2009 | Jackson | |
| 7,592,605 | B2 | 9/2009 | Weisner et al. | |
| 7,626,052 | B2 | 12/2009 | Langstrom et al. | |
| 7,659,317 | B2 | 2/2010 | Eriksson et al. | |
| 7,714,115 | B2 | 5/2010 | Grigg et al. | |
| 7,734,331 | B2 | 6/2010 | Dhawale et al. | |
| 2008/0186802 | A1 * | 8/2008 | Bungay et al. | 366/142 |

FOREIGN PATENT DOCUMENTS

| | | |
|---|---|---|
| EP | 0792253 B1 | 1/2002 |
| EP | 1125304 B1 | 12/2004 |

(Continued)

OTHER PUBLICATIONS

He et al., "A User-Friendly Operating Environment for an Automatic Life Science Laboratory Reagent Manipulating System", Meas. Sci. Technol, vol. 2, pp. 257-261, 1991.

*Primary Examiner* — Matthew O Savage
(74) *Attorney, Agent, or Firm* — Eileen B. Gallagher

(57) ABSTRACT

The present invention relates to functionally closed systems for mixing and delivering microbubble pharmaceuticals. Described is a device comprising a rigid outer layer and a flexible bladder wherein mixing occurs using external mixing sources. Also included is a system for dispensing the pharmaceuticals to its end use after mixing. Methods for mixing and dispensing microbubble pharmaceuticals are also described.

3 Claims, 3 Drawing Sheets

(56) References Cited

FOREIGN PATENT DOCUMENTS

| | | | |
|---|---|---|---|
| EP | 1678102 | B1 | 3/2009 |
| EP | 1933885 | B1 | 8/2009 |
| EP | 1817320 | B1 | 6/2010 |
| EP | 1493161 | B1 | 2/2011 |
| WO | WO9742203 | A1 | 11/1997 |
| WO | WO2011017524 | A1 | 2/2011 |

* cited by examiner

SYSTEM FOR MIXING AND DISPERSING MICROBUBBLE PHARMACEUTICALS

BACKGROUND

This invention relates generally to systems and methods for mixing and dispensing microbubble pharmaceuticals.

Ultrasound-mediated destruction of microbubbles carrying drugs has been found to be useful as a noninvasive drug delivery system. Drugs or other therapeutic agents can be incorporated into the microbubbles in a number of different ways, including binding of the drug to the microbubble shell and attachment of site-specific ligands. For example, perfluorocarbon-filled microbubbles are sufficiently stable for circulating in the vasculature as blood pool agents; they act as carriers of these agents until the site of interest is reached. Ultrasound applied over the skin surface can then be used to burst the microbubbles at this site, causing localized release of the drug at specific site locations. Albumin-encapsulated microbubbles have also been used and delivered to a specific organ target by site-directed acoustic ultrasound.

Typically when the microbubble delivery of an active pharmaceutical ingredient (API) is either an approved drug or during FDA clinical approval, the drug will be mixed with microbubbles just prior to the bolus being given to the patient. When hand mixing these two components there may be variables that cannot be controlled between various locations where the mixing occurs, or between operators. Other parameters, relating to mixing, including pressure and temperature, microbubble stability, and storage may also vary. These parameters are difficult to control manually, thus a method of reducing variability and parameter control is needed to optimize dosage and efficacy of the drug. Furthermore mechanical mixing of the microbubbles with the API must be carefully controlled. Excessive shear or turbulence may also cause rupture of the microbubbles.

Another limitation of current methodology and devices used for preparation and microbubble delivery is that, as with other pharmaceutical samples there is a requirement for maintaining sterility. For pharmaceutical products, sterility assurance is essential and there can be no risk of contamination to the product. Current methods and devices require the sample to be handled and exposed to the environment and current pressure regulating devices often use inlet and exit ports to control pressure by the introduction or removal of gas streams. As such, any pressure control device in contact with the sample will have to be sterilized and sterility will have to be assured during the preparation and delivery of the sample. A system to control pressure in a closed environment is desirable.

Thus, a need therefore exists for microbubble preparation and delivery device that can reduce variability, avoid rupture, and control various parameters. It is also desirable that the device maintains sterility during preparation and drug delivery using a closed system to control pressure.

BRIEF DESCRIPTION

The invention is adapted to address the need for a functionally closed-system for mixing and delivering microbubble pharmaceuticals.

In one embodiment, a device is disclosed that comprises a device for mixing microbubble pharmaceuticals. The device comprises a rigid outer layer and a flexible bladder. The flexible bladder comprises an internal cavity, an inlet port leading into the internal cavity for receiving a microbubble solution and an API solution, and an outlet port for transferring the microbubble pharmaceuticals from the internal cavity. Both the inlet port and the outlet port are capable of forming a closed seal. The device also comprises a heating or cooling source in communication with the flexible bladder for controlling the temperature of the internal cavity, and an external pressure source capable of compressing or expanding the flexible bladder.

In one embodiment a device for mixing and also dispensing microbubble pharmaceuticals is described. The device comprises an inlet station with two or more openings for receiving containers containing microbubble pharmaceutical precursors, a transfer line having a proximal and distal end, wherein the proximal end is in fluid communication with the inlet station openings and the distal end is in fluid communication with a mixing unit. The mixing unit comprises a rigid outer layer and a flexible bladder positioned within the rigid outer layer. The flexible bladder has an internal cavity, an inlet port leading into the internal cavity for receiving material from the transfer line, and an outlet port for dispensing material from the flexible bladder. When closed, both the inlet port and the outlet port are capable of forming closed seals. Also included is a heating or cooling source in communication with the flexible bladder and capable of controlling the temperature of the internal cavity, an external pressure source capable of compressing or expanding the flexible bladder, a switch valve in fluid communication with the outlet port for transferring material from the mixing unit to a separate receptacle, and a processor capable of controlling the operations of the inlet station, mixing unit, switch valve, or a combination thereof.

In one embodiment a method for mixing microbubble pharmaceuticals is disclosed. The method comprises transferring a microbubble solution and an active pharmaceutical ingredient into the mixing unit described above. The method further includes closing the inlet port to obtain a closed mixing environment, and mixing the microbubble solution and the API by compressing or expanding the flexible bladder.

In another embodiment a method for mixing and dispensing microbubble pharmaceuticals is described. The method comprises attaching containers of a microbubble solution and an active pharmaceutical ingredient to an inlet system, transferring the microbubble solution and the active pharmaceutical ingredient from the inlet system to the mixing unit described above, closing the inlet system to create a closed mixing environment, mixing the microbubble solution and the active pharmaceutical ingredient by compressing or expanding the flexible bladder of the mixing unit, activating a switch valve to open an outlet port, and transferring the microbubble pharmaceutical to a receptacle.

Unlike current methods, the methods and systems of the invention enable automated processing and delivery of microbubble-API complex while controlling temperature and pressure in a sterile environment.

BRIEF DESCRIPTION OF THE FIGURES

These and other features, aspects, and advantages of the present invention will become better understood when the following detailed description is read with reference to the accompanying figures wherein.

DETAILED DESCRIPTION

The following detailed description is exemplary and not intended to limit the invention of the application and uses of the invention. Furthermore, there is no intention to be limited by any theory presented in the preceding background of the invention or descriptions of the drawings.

Figure 1:
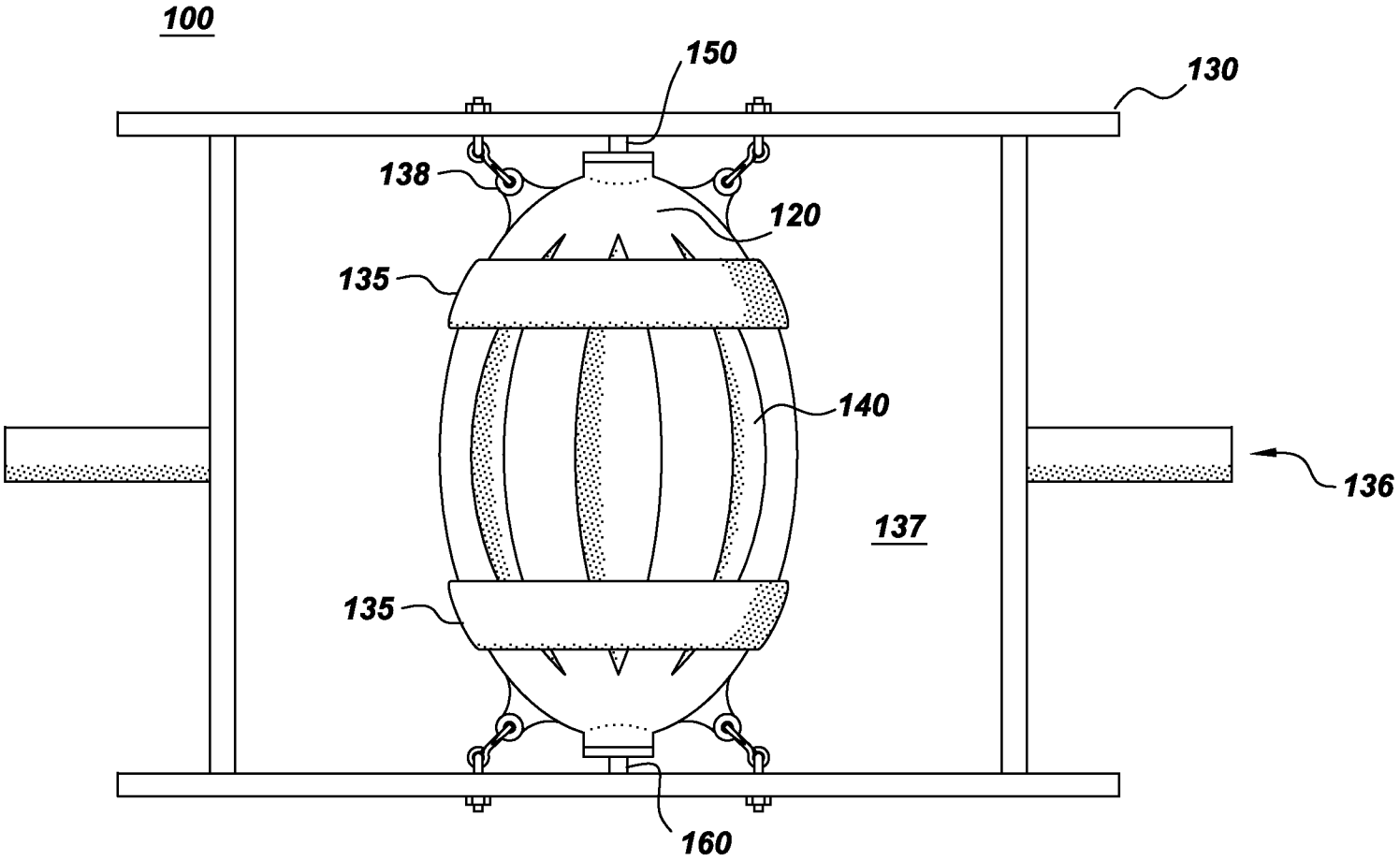
FIG. 1 is a schematic drawing of a mixing unit 100 that allows for mixing an active pharmaceutical ingredient (API) with a microbubble carrier.

FIG. 1 is a schematic drawing of an embodiment of the invention showing a mixing unit 100 that allows for mixing an active pharmaceutical ingredient (API) with a microbubble carrier. As used herein the API and the microbubble carrier may also be referred to generally as microbubble pharmaceuticals. Thus microbubble pharmaceuticals may refer to separate components or the components after mixing. The API binds to the surface of the microbubble, through conjugation with a protein on the microbubble surface. This conjugation may include, but is not limited to, hydrophobic interactions, hydrogen bonding, drug entanglement in the microbubble shell, or combinations thereof. The microbubble then acts as a carrier to transport the API to a target area within the body where it may then be released through the use of ultrasonic energy. The API is an agent that may be used for both diagnostic and therapeutic purposes. In both diagnostic and therapeutic applications, the control of force, temperature, and pressure in the mixing of the API and the microbubble to form the microbubble pharmaceuticals is critical. This is to insure proper conjugation of drug onto the microbubble while still maintaining original microbubble integrity.

During the mixing procedure it is desirable that the microbubble maintain its original size, shell characteristics, and core gas properties. Additionally it is desirable that the drug maintain pharmacological activity and its original chemical structure. The gas core in combination with the albumin shells, gives the microbubble elastic resonance properties that determines the echogenicity in contrast-enhanced ultrasound and provides the means for the microbubble to be visualized while in systemic circulation. This visualization may be monitored into vascular microcirculation as the drug and microbubble bolus arrives on target within the body. As such, the control of pressure as well as temperature is an important factor in forming the microbubble and, subsequently the microbubble-API complex, which may also be referred to as microbubble pharmaceuticals. Mixing velocity, temperature, and pressure control are important for preparing microbubble pharmaceuticals with uniform dimensions and properties e.g., stability, polydispersity, echogenicity and percent of complexation with API.

As shown, the mixing unit 100 has an inner layer which is a flexible bladder 120 positioned in a more rigid outer layer 130. The flexible bladder may be attached to the rigid outer layer using attachment points 138. The attachment points use conventional assembly type methods to attach the bladder to the outer layer including, but not limited to, molded in attachment points, welds, hooks, and tethering points. The flexible bladder is constructed of an inert material and is nonporous.

In still other embodiments, the bladder may be comprised entirely of a transparent material or contain one or more transparent windows for transmission of light. For example the bladder may be a transparent plastic such as, but not limited to polymethyl methacrylate, polycarbonate or polystyrene. Transparency of the material will allow for transmission of light, which may be used for monitoring the content of the bladder.

It is also desirable that the interior of the bladder is a sterile environment. Sterility may be achieved in the manufacturing of the bladder and maintained during assembly. In other embodiments, sterility may be obtained post assembly by heat or chemical treatment. In certain embodiments, the bladder may be designed as a single use component wherein the bladder is replaced prior to each use.

The bladder may be selectively pressurized or deflated by an external supply line 135 positioned around the exterior of the bladder wherein the supply lines itself may be inflated or deflated. In other embodiments, pressurized air may be used in the space 137 formed between the bladder 120 and the rigid outer layer 130 as such the rigid outer layer functions as a pressure chamber around the flexible bladder. In still other embodiments, the rigid outer layer may comprise a mechanical device, that when contacted with the flexible bladder causes constriction of the bladder. For example in certain embodiments the mechanical device may be, but not limited to, a compression plate, a plunger, or a vice that is part of the rigid outer layer. This is shown in FIG. 1 where the rigid outer layer 130 comprises a mechanical compression plate 136. The mechanical device is designed such that no rupturing or tearing of the bladder occurs. The bladders design ensures that exterior air does not come into contact with the internal content of the bladder. In still other embodiments, a mechanical device such as a compression chamber may be used to compress the exterior walls of the bladder.

In another embodiment the bladder may be pressurized or deflated by contraction of the outer layer causing compression of the flexible bladder to occur. By changing the amount of compression on the flexible bladder, mixing occurs within the contents of the internal chamber of the bladder; microbubble solution and API solution. In another embodiment the bladder may be depressurized during cycles where less than atmospheric pressure is needed. This may include but is not limited to injection start cycles, where bulk ingredients are injected into the bladder before mixing. This expansion may reduce pressure during injection and potentially reduce the risk of microbubble collapse during the start of the mixing cycle. Additionally during high energetic mixing a lowered pressure may be needed to reduce microbubble collapse. Utilizing tethering points to pull the exterior of the bag may reduce the inner-bladder pressure. The tethering points may be the same material projections of the inner bag that are located for example, three exterior points on the bag. Pulling attachments to those tethers, using a mechanical device, will expand the bag volume and thus reduce internal mixing bag pressure.

Mixing occurs without the use of an internal mixing device; such as a stirring bar, motorized blades, mixing shaft, or gas jets. As such the lack of an internal mixing device limits the amount of rupture of microbubble, which may be caused by contact with an internal device. Internal mixing will create shear forces and contact forces that can be detrimental to microbubble stability. In this process of mixing it is desirable that microbubbles do not rupture, fracture, or coalesce into different sizes. Changes in microbubble size will effective tissue biodistribution of the microbubble, may diminish echogenicity, or change the drug loading capacity or capability.

In certain embodiments, an external rocking, vibrating or rotating mechanism may be added to increase mixing efficiency, without the need for an internal mixing device. The device may be mounted to the mixing unit such as a rocker table or vibrating support platform. In still other embodiments, fins 140 may be added to the flexible bladder such that interior sidewalls are formed. These fins define an interior space that acts as a baffle system to increase surface contact between the bladder and the fluid contained within; and to increase turbulence when mixing. The interior fins may be composed of the same material as the flexible bladder. In other embodiments, the interior fins may be composed of a more rigid material.

A combination of conductive, convective, and radiative heating may be used to control the internal temperature. In each case the heat source is in communication with the flexible bladder in a manner to supply heat or cooling to the content of the bladder.

In certain embodiments, the temperature the flexible bladder, and contents of the bladder, may be maintained by one or more thermal couplers attached to the bladder (not shown). In other embodiments, the heating or cooling source is thermal coupled electronics that may add heat to the walls of the rigid outer layer 130 and where the walls are thermally conductive. By application of electrical resistance to a thermal conductive wall the mixing bag may be heated by conductive and radiate forces. Conversely cooling may be accomplished by a peltier cooler.

In another embodiment a series of holes in the walls of the mixing chamber may be used to allow for hot or cold air to come into and circulate through the system. The circulating air may control internal temperature in the mixing bag. The heating and cooling elements may be driven by a set of exterior fans and heat transfer pumps.

Changes in temperature will also result in local pressure changes, which also may be controlled as described above. The computer monitoring system may make these adjustments based on known physical laws that regulate pressure, heat, and volume dimensions.

To function, the bladder has inlet and outlet values 150 and 160 respectively that may be selectively opened or closed. When closed the inlet and outlet valves are sealed, creating a functionally closed system.

Figure 2:
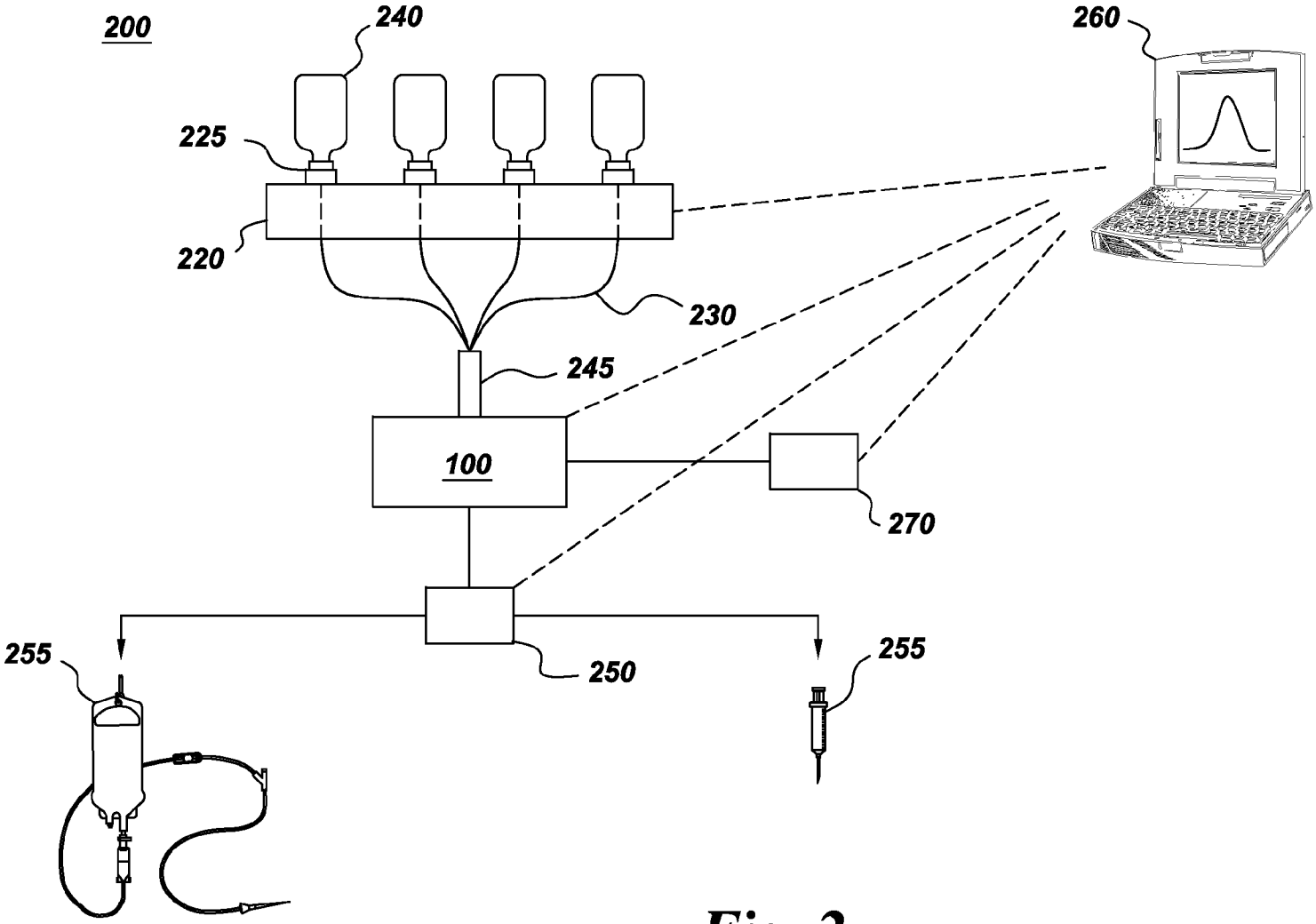
FIG. 2 is a schematic drawing of the mixing unit 100 incorporated into a microbubble pharmaceutical preparation and delivery system 200.

In certain embodiments, the mixing unit 100 may be incorporated into a microbubble preparation and delivery system 200. FIG. 2. is a schematic drawing of one embodiment of the system. The system 200 is an integrated system for production, quality control and distribution of a microbubble-API containing pharmaceutical.

System 200 includes the mixing unit 100 and an inlet station 220 designed for accepting various containers 240. The inlet system is capable of transferring pharmaceutical products from one or more containers into, the mixing unit 100, more specifically to the flexible bladder 120 of the mixing unit. The device ensures that the pharmaceutical product may be dispensed in a precise aliquot, based on weight or volume controls, and transferred in a sterile environment. In certain embodiments, weight and volume control may be accomplished using a flow meter, optical sensors or balances positioned within the entrance to the mixing unit.

As the drug and microbubble that are to be mixed are already identified and the dimensions of the containers and inlet station are known, then the optical sensors can determine a flow rate and thus precisely determine the amount of material added. In another embodiment this may be achieved with precision weight determination; using weight mass relationships. In other embodiments, weight or volume control may be accomplished through controlling the weight and volume of the contents of the containers 240 prior to attaching the containers to the inlet station.

In certain embodiments, the inlet station 220 has multiple inlet values 225 and is in fluid communication with the mixing unit 100 through individual pathways, such that each inlet value has a separate transfer line 230 to the mixing unit 200. As shown, the proximal end of the transfer line is in fluid communication with the inlet station openings, while the distal end is in fluid communication with the flexible bladder contained within the mixing unit. Transferring of material from the inlet station to the mixing unit may be through gravity feed or assisted using a pumping mechanism.

In still other embodiments, the transfer line may be configured in such a way to direct multiple samples into a common path (not shown) in order to control flow into the system or maintain sterility. As such the transfer line may have a one-way valve, a dynamic seal, or a hermetic seal, 245.

In certain embodiments, the inlet station may be designed to limit access to the mixing unit from non-approved sources. For example, the inlet system may have a unique fitting port design to match only with containers of API or microbubbles which have been approved for use or administration. In still other examples the inlet system may have a verification device, such as a barcode reader or a RFID sensor, which may scan the container. In still other embodiments, only approved containers may access the inlet system by accessing an electronic or mechanical inter-lock. In still other embodiments, components of the system may have predefined sizes and shapes that are designed to physically integrate with each other. The integrated shapes allow the components to fit together within a prescribed tolerance to allow verification and to provide a sealed path through the system to insure sterility is maintained.

System 200 also comprises a switch value 250 in fluid communication with the outlet ports 160 of the mixing unit 100. The switch valve 250 is configured to dispense the content of the mixing unit into a receptacle 255. The receptacle may be a syringe, IV bag, reservoir for transferring the component to a patient's bedside, or a combination thereof. In certain embodiments, the switch valve may be controlled by a processor 260 to allow the components of the mixing unit to be dispensed in a predetermined amount. The processor acts as a control system and is operable to receive status information from, and to send instructions to various components of the microbubble preparation and delivery system 200.

In some embodiments, the system may also include a quality control unit (QC) 270 that monitors the quality and quantity of the components prior to dispersion. In one embodiment, the QC unit 270 would use noninvasive techniques that would allow sterility of the pharmaceutical to be maintained. For instance, the use of absorption spectroscopy may be used to measure concentration while infrared pyrometers may be used to measure temperature. Level indicators on the outside of the flexible bladder may also be used. As such the QC unit would not physically come in contact with the pharmaceutical. This provides a method of having the contents quality controlled and non-invasively tested to assure that physical characteristics of the mix ingredient have not changed and have not deteriorated during mixing.

In one embodiment, the QC unit 270 may be coupled to the mixing unit and be configured to be in communication with the processor 260. The QC unit may be configured to obtain at least one QC parameter and communicate QC data to the processor for comparing to a preselected quality parameter for tracking and verification. In certain embodiments, the processor 260 may have a graphical user interface which may allow an operator to control, manage, and monitor the mixing and dispersion process, including dosing. It may also be used for in process adjustments to allow the pharmaceutical to meet quality control parameters prior to release. For example, in certain embodiments, an end-use acceptable value must be obtained prior to release. As such the end-use value is a pre-determined quality control parameter or range.

The embodiment described is only an example configuration of the system. The number and type of components can be varied as needed for a given set up and the order and flow of materials through the system may be varied as well as needed.

Figure 3:
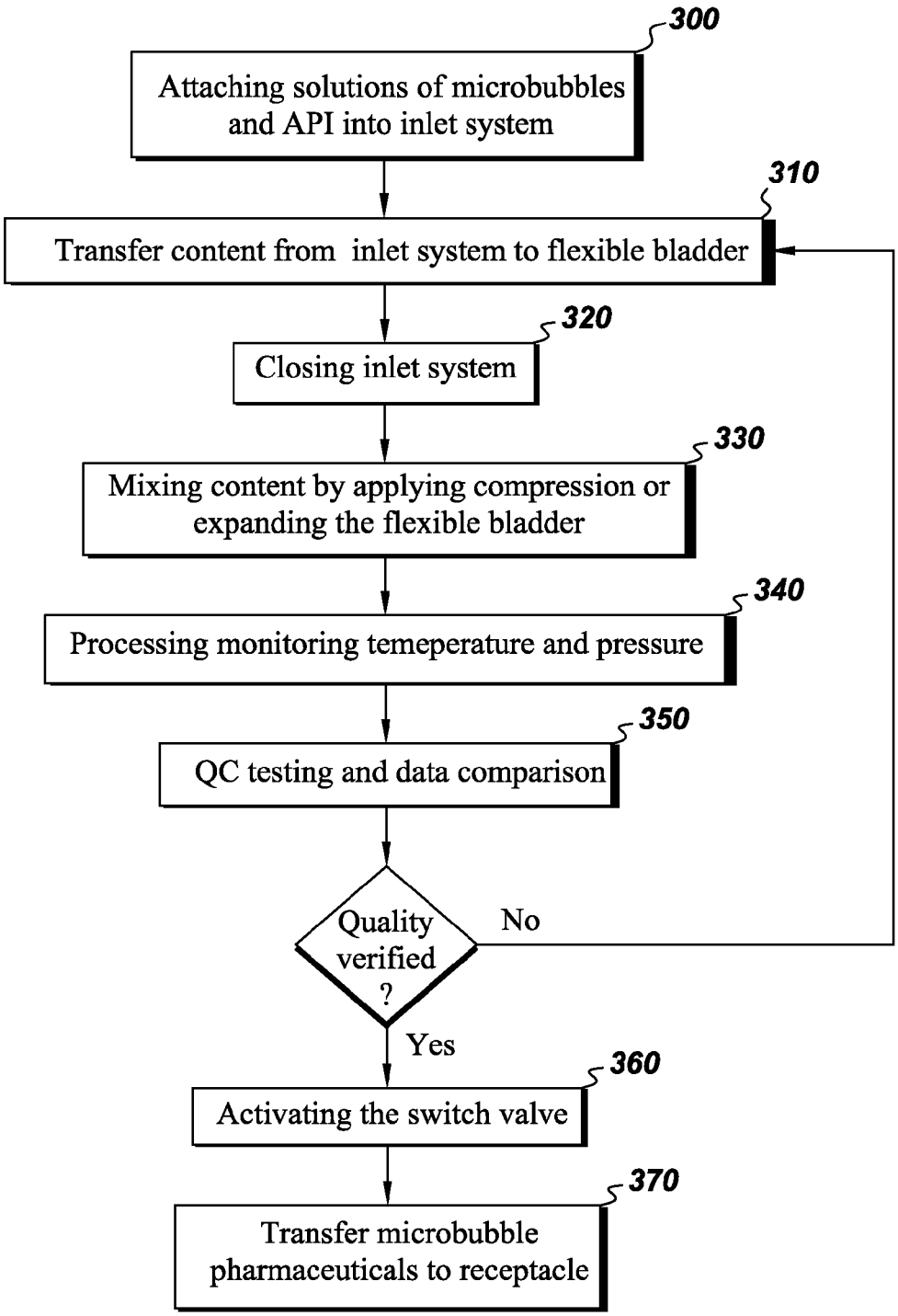
FIG. 3 is a flowchart showing a method of operation of the microbubble pharmaceutical preparation and delivery system 200.

FIG. 3 is a flowchart showing an embodiment of a method of operation of the microbubble preparation and delivery system 200. The method may be performed by an operator prior to the administration of the microbubble pharmaceutical to a patient. The method may also be performed by an operator to prepare a microbubble pharmaceutical to be stored for future use.

Accordingly a microbubble pharmaceutical may be prepared by attaching various containers containing solutions of API and microbubbles to the inlet system 220 (300) and transferring the contents of the containers into the flexible bladder 120 of the mixing unit 100 (310). The transferring of the components from the inlet system to the flexible bladder may be controlled using a processor 260, or it may be controlled based on a preselected aliquot or premeasuring the contents of the containers. Controlling the transfer of the components from the inlet system with a processor 260, may be advantageous as it provides both quantitatively and qualitatively controlled. This affords a correct mixing ratio as well as rate.

In certain embodiments, the processor also allows for a stepwise addition such that the reaction, between the microbubble and the API, occurs using prescribed process steps. QC analysis during the mixing step also allows for any adjustments to the system. The contents of the containers may include the microbubbles, one or more API, and in certain embodiments, pharmaceutical carriers. Pharmaceutical carriers refer to materials that may be added to the microbubble pharmaceutical for stability or to increase the efficacy of the complex. These may include solubilization strategies such as but not limited to: pH adjustments, use of co-solvents, complexation, surfactants and micelles, emulsions and microemulsions, and microbubble linkers, The inlet system is closed (320), creating a closed mixing environment. Mixing occurs by compressing or expanding the flexible bladder (330). In certain embodiments, the external compression is regulated using an external supply line or pressurized air around the bladder. In certain embodiments, expansion of the flexible bladder is used for mixing. This may be accomplished by using tethering point attachments, and mechanically pulling on the attachment to expand the flexible bladder.

As described above, the mixing unit 100 is used to maintain sterility while controlling pressure and temperature of the microbubble pharmaceutical during formation and delivery. Pressure and temperature control are important to maintain the gas filled core of the micro sphere and to enhance the incorporation of API into or onto the microbubble shell. Additionally temperature regulation will prevent reactions that near the melting point of either microbubble or API.

Monitoring and control of the temperature and pressure during mixing within the bladder is controlled by the processor 260 (340). Pressure is controlled by the application and release of compression on the flexible bladder. In certain embodiments, temperature may be controlled through external heating and cooling. Thermal couplers that surround the flexible bladder may control temperature.

In certain embodiments, QC monitoring occurs to adjust mixing parameters and to test the microbubble pharmaceutical prior to release (350). As such, in certain embodiment, the QC unit may obtain at least one QC parameter and communicate the QC data to the processor for comparing to a preselected quality parameter for tracking and verification. In certain embodiments adjustments may be made to the solution in the bladder based on the QC test. If the quality control is not met, the processor may release additional microbubbles, one or more API, pharmaceutical carriers, or a combination thereof, from the inlet system and allow for additional mixing In certain embodiments, an external rocking or rotating mechanism may also be added to increase mixing efficiency. In still other embodiments, internal fins or sidewalls may be present in the bladder and, upon external compression or expansion, these sidewalls acts as a baffle to increase surface contact between the bladder and the fluid contained within; and to increase turbulence when mixing.

Activating the switch value 250, (360) transfers the microbubble pharmaceutical from the mixing unit to a receptacle after mixing is complete (370). In certain embodiments, quality control test and in-line monitoring may be performed to verify efficacy of the agent prior to release.

The invention may be embodied in other specific forms without departing from the spirit or essential characteristics thereof. The foregoing embodiments are therefore to be considered in all respects as illustrative rather than limiting on the invention described herein. The scope of the invention is thus indicated by the appended claims rather than by the foregoing description, and all changes that come within the meaning and range of equivalency of the claims are therefore intended to be embraced therein.

The invention claimed is:

1. A device for mixing microbubble pharmaceuticals, the device comprising:

a rigid outer layer comprising a compression plate, wherein the rigid outer layer and the pressure plate together form a space that can be pressurized with air at a pressure that is higher than an ambient atmosphere surrounding the device;

a flexible bladder positioned within the space, said flexible bladder comprising, an internal cavity, an inlet port for receiving the microbubble pharmaceuticals into the internal cavity and adapted to form a closed seal, and an outlet port for transferring the microbubble pharmaceuticals out of the internal cavity and adapted to form a closed seal, a heating or cooling source in communication with the flexible bladder and capable of controlling the temperature of the internal cavity, and wherein said space surrounds the flexible bladder and is filled with pressurized air at a pressure that is higher than said ambient pressure; and, wherein the compression plate is capable of being moved in a direction towards the flexible bladder to constrict the bladder and in a direction away from the bladder to permit expansion of the bladder thereby causing mixing of fluid contained within the bladder.

2. The device of claim 1 wherein the flexible bladder further comprises one or more fins forming side walls in the interior cavity of the bladder.

3. The device of claim 1 wherein the flexible bladder further comprises tethering point attachments, wherein pulling on said attachment expands the flexible bladder.

* * * * *